US010589345B2

(12) United States Patent
Takagawa et al.

(10) Patent No.: US 10,589,345 B2
(45) Date of Patent: Mar. 17, 2020

(54) MOLD MANUFACTURING METHOD

(71) Applicant: KOBE STEEL, LTD., Hyogo (JP)

(72) Inventors: Yusaku Takagawa, Hyogo (JP); Kazuyuki Tsutsumi, Hyogo (JP)

(73) Assignee: Kobe Steel, Ltd., Hyogo (JP)

( * ) Notice: Subject to any disclaimer, the term of this patent is extended or adjusted under 35 U.S.C. 154(b) by 0 days.

(21) Appl. No.: 16/330,752

(22) PCT Filed: Sep. 1, 2017

(86) PCT No.: PCT/JP2017/031602
§ 371 (c)(1),
(2) Date: Mar. 5, 2019

(87) PCT Pub. No.: WO2018/047737
PCT Pub. Date: Mar. 15, 2018

(65) Prior Publication Data

US 2019/0224743 A1 Jul. 25, 2019

(30) Foreign Application Priority Data

Sep. 7, 2016 (JP) ..... 2016-174863

(51) Int. Cl.
*B22C 1/22* (2006.01)
*B22C 9/02* (2006.01)
*B22C 9/00* (2006.01)

(52) U.S. Cl.
CPC ..... *B22C 1/22* (2013.01); *B22C 9/00* (2013.01); *B22C 9/02* (2013.01)

(58) Field of Classification Search
CPC ..... B22C 1/22; B22C 9/00; B22C 9/02
See application file for complete search history.

(56) References Cited

U.S. PATENT DOCUMENTS 3,978,906 A * 9/1976 Lemon ..... B22C 9/00 164/39
4,185,002 A * 1/1980 Nakamura ..... B22C 1/22 523/437

(Continued)

FOREIGN PATENT DOCUMENTS

CN 105658352 A 6/2016
JP 2009-285729 A 12/2009

(Continued)

OTHER PUBLICATIONS

International Search Report issued in PCT/JP2017/031602; dated Oct. 24, 2017.

(Continued)

*Primary Examiner* — Kevin E Yoon
(74) *Attorney, Agent, or Firm* — Studebaker & Brackett PC

(57) ABSTRACT

A mold molding method includes a binder reaction amount calculation step of calculating a reaction amount $\Delta C(\theta, t_i)$ [wt %] (i=1, 2) of a binder, a specimen room temperature compressive strength calculation step of calculating room temperature compressive strength $\sigma_c(\theta, t)$ [MPa] of a specimen, a mold room temperature compressive strength prediction step of predicting room temperature compressive strength $\sigma_{ca}(\theta, t)$ of the mold in advance, and a mold room temperature compressive strength extraction step of extracting room temperature compressive strength $\sigma_{ce}(\theta, t)$ of the mold. When the mold is actually molded, the model is removed just after elapse of the time $t_1$, as one of the molding condition parameters which satisfies the room temperature compressive strength $\sigma_{ce}(\theta, t)$.

4 Claims, 8 Drawing Sheets

(56) References Cited

U.S. PATENT DOCUMENTS

| | | | | |
|---|---|---|---|---|
| 2011/0100578 | A1 | 5/2011 | Ina et al. | |
| 2013/0008625 | A1 | 1/2013 | Yoshida et al. | |
| 2015/0246387 | A1* | 9/2015 | Bartels | B22C 1/181 164/22 |
| 2015/0361619 | A1* | 12/2015 | Ikenaga | D21H 15/02 162/147 |
| 2016/0250680 | A1 | 9/2016 | Polzin et al. | |
| 2016/0303645 | A1 | 10/2016 | Tsutsumi et al. | |

FOREIGN PATENT DOCUMENTS

| | | | |
|---|---|---|---|
| JP | 2011-224592 | A | 11/2011 |
| JP | 2012-148340 | A | 8/2012 |
| JP | 2015-128791 | A | 7/2015 |
| TW | 201504184 | A | 2/2015 |
| WO | 2011/115258 | A1 | 9/2011 |

OTHER PUBLICATIONS

Written Opinion issued in PCT/JP2017/031602; dated Oct. 24, 2017.

* cited by examiner

MOLD MANUFACTURING METHOD

TECHNICAL FIELD

The present invention relates to a method of molding a mold using self-hardening sand.

BACKGROUND ART

In a typical mold molding method, a mold is molded by filling a frame, in which a model is placed, with self-hardening sand obtained by kneading sand, a binder, and hardening accelerator, and removing the model (hereinafter referred to as "model removal") after the self-hardening sand is hardened, so that a shape of the model is transferred to the hardened self-hardening sand.

There has been known a mold molding method in which a mold having a complicated shape necessary for casting a product having a twisted shape such as a male rotor or female rotor of a screw compressor is molded using a model by the above mold molding method (see, for example, Patent Literature 1).

By using the technique disclosed in Patent Literature 1, it is possible to reduce a process margin of a cast product and achieve a near-net-shape cast product.

CITATION LIST

Patent Literature

Patent Literature 1: JP-A-2015-128791

SUMMARY OF INVENTION

Technical Problems

However, regarding room temperature compressive strength of the self-hardening sand which is considered to affect a force required for removing the model and strength of the mold, the technique disclosed in Patent Literature 1 merely takes into consideration time from an end of kneading of the self-hardening sand to model removal.

Accordingly, conventional model removal timing is not applicable when the mold is actually molded, since the room temperature compressive strength of the self-hardening sand changes depending on a change of, for example, a temperature of sand constituting the self-hardening sand as a molding condition parameter.

Therefore, there is a problem that a test must be carried out each time in order to optimize the model removal timing (that is, the model removal timing when the mold can be molded without damages and the model can be removed).

An object of the present invention is to provide a mold molding method by which a mold can be molded without damages and a model can be removed without tests each time even when a molding condition changes when the mold is actually molded.

Solution to Problems

In order to achieve this object, a first aspect of the present invention provides a mold molding method that molds a mold by filling a frame, in which a model is placed, with self-hardening sand obtained by kneading sand, a binder, and a hardening accelerator, and removing the model after the self-hardening sand is hardened, so that a shape of the model is transferred to the hardened self-hardening sand, the mold molding method including:

a binder reaction amount calculation step of calculating a reaction amount $\Delta C(\theta, t_i)$ [wt %] (i=1, 2) of the binder based on the following equations (1) and (2) using, as molding condition parameters when a specimen is molded using the self-hardening sand, temperature $\theta$ [° C.] of the sand before kneading, time $t_1$ [min] from an end of the kneading to a time point when the model has been removed from the hardened self-hardening sand, and time $t_2$ [min] from the time point just after the model has been removed from the hardened self-hardening sand to a time point just before the specimen is subjected to a compression test;

a specimen room temperature compressive strength calculation step of calculating room temperature (here, the "room temperature" refers to ambient temperature during molding) compressive strength $\sigma_c(\theta, t)$ [MPa] of the specimen by substituting the reaction amounts $\Delta C(\theta, t_1)$ and $\Delta C(\theta, t_2)$ calculated in the binder reaction amount calculation step into the following equation (3);

a mold room temperature compressive strength prediction step of predicting room temperature compressive strength $\sigma_{ca}(\theta, t)$ of the mold in advance by applying the room temperature compressive strength $\sigma_c(\theta, t)$ of the specimen calculated in the specimen room temperature compressive strength calculation step to room temperature compressive strength $\sigma_{ca}(\theta, t)$ of the mold when the mold is molded using the self-hardening sand under the molding condition parameters; and a mold room temperature compressive strength extraction step of extracting room temperature compressive strength $\sigma_{ce}(\theta, t)$ of the mold, under which the mold can be molded without damages and the model can be extracted, from the predicted room temperature compressive strength $\sigma_{ca}(\theta, t)$ of the mold by a test in advance, wherein when the mold is actually molded, the model is removed after elapse of the time $t_1$, as one of the molding condition parameters which satisfies the room temperature compressive strength $\sigma_{ce}(\theta, t)$ extracted in the mold room temperature compressive strength extraction step:

[Math. 1]

$$\Delta C(\theta,t_i)=\Delta C_{sat}\cdot\{1-\exp(-k_{di}t_i)\} \quad (1)$$

wherein $\Delta C_{sat}$: a saturated reaction amount [wt %] of the binder, and $k_{di}$(i=1, 2): reaction rate constant [l/min] of the binder;

[Math. 2]

$$k_{di}=A_i\exp(\alpha_i\theta) \quad (2)$$

wherein $A_i$ (i=1, 2) and $\alpha_i$ (i=1, 2): parameters dependent on kind of the binder used

[Math. 3]

$$\sigma_c(\theta,t)=\{\tan h(\beta\cdot\Delta C(\theta,t_1))+\gamma\}+\{\tan h(\varepsilon(\theta)\cdot\Delta C(\theta,t_2)-\eta)\} \quad (3)$$

wherein $\beta$, $\gamma$ and $\eta$: material parameters, and $\varepsilon$: constant determined by the temperature $\theta$.

According to a second aspect of the present invention, in the mold molding method according to the first aspect, the room temperature compressive strength $\sigma_{ce}(\theta, t)$ satisfies: 0.5 [MPa]$\geq\sigma_{ce}(\theta, t)$ [MPa]$\leq$2.2 [MPa].

According to a third aspect of the present invention, in the mold molding method according to the first or the second aspect, the temperature of the sand is 5 to 30° C.

Advantageous Effects of Invention

As described above, the present invention provides a mold molding method that molds a mold by filling a frame, in which a model is placed, with self-hardening sand obtained by kneading sand, a binder, and a hardening accelerator, and removing the model after the self-hardening sand is hardened, so that a shape of the model is transferred to the hardened self-hardening sand.

The mold molding method includes:

a binder reaction amount calculation step of calculating a reaction amount $\Delta C(\theta, t_i)$ [wt %] (i=1, 2) of the binder based on the above equations (1) and (2) using, as molding condition parameters when a specimen is molded using the self-hardening sand, temperature θ [° C.] of the sand before kneading, time $t_1$ [min] from an end of the kneading to a time point when the model has been removed from the hardened self-hardening sand, and time $t_2$ [min] from the time point just after the model has been removed from the hardened self-hardening sand to a time point just before the specimen is subjected to a compression test;

a specimen room temperature compressive strength calculation step of calculating room temperature compressive strength $\sigma_c(\theta, t)$ [MPa] of the specimen by substituting the reaction amounts $\Delta C(\theta, t_1)$ and $\Delta C(\theta, t_2)$ calculated in the binder reaction amount calculation step into the above equation 3);

a mold room temperature compressive strength prediction step of predicting room temperature compressive strength $\sigma_{ca}(\theta, t)$ of the mold in advance by applying the room temperature compressive strength $\sigma_c(\theta, t)$ of the specimen calculated in the specimen room temperature compressive strength calculation step to room temperature compressive strength $\sigma_{ca}(\theta, t)$ of the mold when the mold is molded using the self-hardening sand under the molding condition parameters; and a mold room temperature compressive strength extraction step of extracting room temperature compressive strength $\sigma_{ce}(0, t)$ of the mold, under which the mold can be molded without damages and the model can be extracted, from the predicted room temperature compressive strength $\sigma_{ca}(\theta, t)$ of the mold by a test in advance.

When the mold is actually molded, the model is removed after elapse of the time $t_1$, as one of the molding condition parameters which satisfies the room temperature compressive strength $\sigma_{ce}(\theta, t)$ extracted in the mold room temperature compressive strength extraction step.

As described above, the present invention includes the mold room temperature compressive strength prediction step of predicting the room temperature compressive strength $\sigma_{ca}(\theta, t)$ of the mold in advance with high accuracy under the molding condition parameters for molding the mold, and the mold room temperature compressive strength extraction step of extracting the room temperature compressive strength $\sigma_{ce}(\theta, t)$ of the mold, under which the mold can be molded without damages and the model can be removed, from the above predicted room temperature compressive strength $\sigma_{ca}(\theta, t)$ of the mold by a test in advance. Therefore, when the mold is actually molded, the selection of the molding condition parameters which satisfy the room temperature compressive strength $\sigma_{ce}(\theta, t)$ of the mold extracted in the mold room temperature compressive strength extraction step is just required even when the above molding condition parameters change. That is, the removal of a model just after elapse of the time $t_1$ as one of the selected molding condition parameters is just required.

Accordingly, even when molding conditions change when the mold is actually molded, the mold can be formed without damages and the model can be removed without carrying out a test each time the molding conditions change.

DESCRIPTION OF EMBODIMENTS

Figure 1:
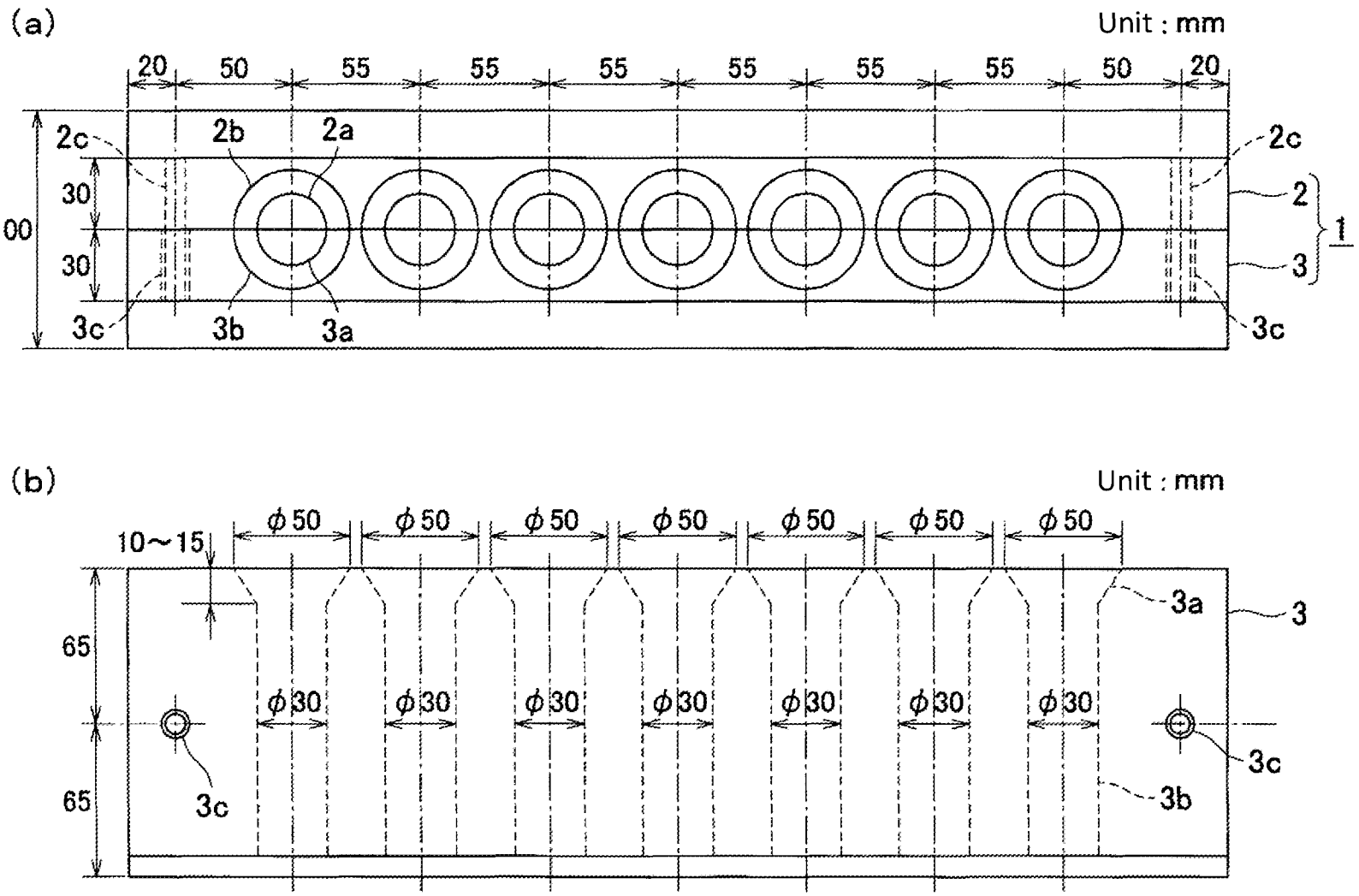
FIG. 1 illustrates a mold configured to mold a specimen, and (a) of FIG. 1 is a top view thereof, and (b) of FIG. 1 is a front view thereof.

The present inventors carried out intensive studies on how to realize a mold molding method by which a mold can be molded without damages and a model can be removed without carrying out a test each time when a molding condition changes when a mold is actually molded. As a result, it is found that such a purpose can be achieved for a first time by adopting the configuration to be described below.

(Mold Molding Method of Present Invention)

In the mold molding method of the present invention, a mold is molded by filling a frame, in which a model which is, for example, made from wood, resin or metal is placed, with self-hardening sand obtained by kneading sand, a binder, and a hardening accelerator, and removing the model (hereinafter, referred to as "model removal") after the self-hardening sand is hardened, so that a shape of the model is transferred to the hardened self-hardening sand.

The mold molding method includes:

a binder reaction amount calculation step of calculating a reaction amount $\Delta C(\theta, t_i)$ [wt %](i=1, 2) of the binder based on the following equations (1) and (2) using, as molding condition parameters when a specimen is molded using the self-hardening sand, temperature θ [° C.] of the sand before kneading, time $t_1$ [min] from an end of the kneading to a time point when the model has been removed from the hardened self-hardening sand, and time $t_2$ [min] from the time point just after the model has been removed from the hardened self-hardening sand to a time point just before the specimen is subjected to a compression test;

a specimen room temperature compressive strength calculation step of calculating room temperature (here, "room temperature" refers to ambient temperature during molding) compressive strength $\sigma_c(\theta, t)$ [MPa] of the specimen by substituting the reaction amounts $\Delta C(\theta, t_1)$ and $\Delta C(\theta, t_2)$ calculated in the binder reaction amount calculation step into the following equation (3);

a mold room temperature compressive strength prediction step of predicting room temperature compressive strength $\sigma_{ca}(\theta, t)$ of the mold in advance by applying the room temperature compressive strength $\sigma_c(\theta, t)$ of the specimen calculated in the specimen room temperature compressive strength prediction step to room temperature compressive strength $\sigma_{ca}(\theta, t)$ of the mold when the mold is molded using the self-hardening sand under the molding condition parameters; and a mold room temperature compressive strength extraction step of extracting room temperature compressive strength $\sigma_{ce}(\theta, t)$ of the mold, under which the mold can be molded without damages and the model can be removed, from the above predicted room temperature compressive strength $\sigma_{ca}(\theta, t)$ of the mold by a test in advance.

When the mold is actually molded, the model is removed after elapse of the time $t_1$, as one of the molding condition parameters which satisfies the room temperature compressive strength $\sigma_{ce}(\theta, t)$ extracted in the mold room temperature compressive strength extraction step.

[Math. 4]

$$\Delta C(\theta,t_i)=\Delta C_{sat}\cdot\{1-\exp(-k_{di}t_i)\} \quad (1)$$

Here, $\Delta C_{sat}$: a saturated reaction amount [wt %] of the binder, and $k_{di}$ (i=1, 2): reaction rate constant [l/min] of the binder.

[Math. 5]

$$k_{di}=A_i\exp(\alpha_i\theta) \quad (2)$$

Here, $A_i$ (i=1, 2) and $\alpha_i$ (i=1, 2): parameters dependent on kind of the binder used.

[Math. 6]

$$\sigma_c(\theta,t)=\{\tan h(\beta\cdot\Delta C(\theta,t_1))+\gamma\}+\{\tan h(\varepsilon(\theta)\cdot\Delta C(\theta,t_2)-\eta)\} \quad (3)$$

Here,

β, γ and η: material parameters, and

ε: constant determined by the temperature θ.

The self-hardening sand is used as a mold material. The self-hardening sand is made of the sand, the binder, and the hardening accelerator (also referred to as hardening agent).

The sand may be new or reclaimed sand having a polygonal or spherical shape and a particle size of AFS130 or less.

The binder may be an acid hardening furan resin containing furfuryl alcohol. Additionally, an alkali phenol-based resin may also be used. Hereinafter, the furan resin is mainly described as the binder.

The hardening accelerator may be a xylene sulfonic acid-based hardening agent, a sulfuric acid-based hardening agent, or a mixture of both. As the hardening accelerator, any hardening accelerators may be selected as long as hardening accelerators are compatible with a resin as the binder. Hereinafter, a mixture of xylene sulfonic acid-based hardening accelerators having different concentrations is mainly described as the hardening accelerator.

For example, amounts of the resin and the hardening agent added to the sand are desirably 0.8 wt % and 0.32 wt %, respectively.

First, "reaction of furan resin" and "room temperature compressive strength of hardened self-hardening sand" are described below first, which are a basis of a technical idea in the mold molding method of the present invention.

(Reaction of Furan Resin)

Assuming that a dehydration condensation reaction of the furan resin constituting the self-hardening sand is a primary reaction, the following equation (4) is satisfied.

[Math. 7]

$$\ln\frac{C_0}{C_t}=k_d t \quad (4)$$

Here, $C_0$ is an initial concentration [wt %] of the furan resin, $C_t$ is an unreacted resin concentration [wt %] at a time point after elapse of a certain time t [min] from the end of the kneading of the sand, binder, and hardening accelerator for the self-hardening sand, and $k_d$ is reaction rate constant [l/min] of the resin. It is considered that a reaction rate of the resin is different depending on the elapse time t, that is, the reaction rate of the resin at the time $t_1$ [min] from the end of the kneading to a time point just before the model removal (that is, when the model exists in the hardened self-hardening sand or when the specimen is located in the mold) is different from that at the time $t_2$ [min] from a time point just after the model removal (that is, a time point when the model has been removed from the hardened self-hardening sand or when the specimen is taken out of the mold) to a time point when the hardened self-hardening sand is left in the atmosphere for certain time (or just before the specimen is subjected to a compression test after being left in the atmosphere).

Assuming that the reaction is the primary reaction both in the cases of the time $t_1$ and the time $t_2$ (that is, $t_i=t_1$ or $t_2$) as molding condition parameters, the above equation (4) is rewritten as in the following equation (5) for the cases of the time $t_1$ and the time $t_2$.

[Math. 8]

$$\ln\frac{C_0}{C_{ti}}=k_{di}t_i,\ i=1,2 \quad (5)$$

Here, $k_{di}$ in the above equation (5) is reaction rate constant [l/min] of sin in the cases of the time $t_1$ and the time $t_2$ (that is, $t_i=t_1$ or $t_2$).

<Binder (Resin) Reaction Amount Calculation Step>

When a reaction amount of the resin at time points when $t_i=t_1$ or $t_2$ [min] elapses at the temperature θ [° C.] of the sand before kneading as a molding condition parameter is taken as $\Delta C(\theta, t_i)$ [wt %], the above equation (5) can be rewritten as in the following equation (6).

[Math. 9]

$$\Delta C(\theta, t_i) = f_i(\theta)\cdot\left(1-\frac{C_{ti}}{C_0}\right) = f_i(\theta)\cdot\{1-\exp(-k_{di}t_i)\} \quad (6)$$

Here, $f_i(\theta)$ is a function of the temperature θ of the sand. Considering that a reaction degree of the resin approaches 100% over the time $t_1$ regardless of the temperature θ of the sand, the above equation (6) can be rewritten as in the following equation (1).

[Math. 10]

$$\Delta C(\theta,t_i)=\Delta C_{sat}\cdot\{1-\exp(-k_{di}t_i)\} \quad (1)$$

Here, $\Delta C_{sat}$: a saturated reaction amount [wt %] of the binder, and $k_{di}$(i=1, 2): reaction rate constant [l/min] of the binder.

It is also considered that the reaction rate of the resin changes depending on the temperature θ of the sand. That is, the reaction of the resin is faster as the temperature is higher. Therefore, it is necessary to consider temperature dependence of the reaction rate constant $k_{di}$ of the resin. The temperature dependence can be expressed by Arrhenius equation in the following equation (7).

[Math. 11]

$$k_{di} = A_i\exp\left(-\frac{\Delta E_i}{R\theta}\right),\ i = 1, 2 \quad (7)$$

Here, $A_i$ (i=1, 2) is an occurrence factor, ΔE is activation energy [J/mol], and R is gas constant [J/(mol·K)]. For simplicity, the equation (7) can be rewritten as in the following equation (2).

[Math. 12]

$$k_{di}=A_i\exp(\alpha_i\theta) \quad (2)$$

Here, $A_i$ (i=1, 2) and $\alpha_i$ (i=1, 2): parameters dependent on kind of the binder used Here, $\alpha_i$ is defined as in the following equation (8).

[Math. 13]

$$\alpha_i \equiv \frac{R}{\Delta E_i} \quad (8)$$

The above $A_i$ and $\alpha_i$ can be obtained from a weight measurement test of the specimen to be described below, and the like.

The temperature θ of the sand is preferably 5 to 30° C. When the temperature θ of the sand is less than 5° C., the sand does not solidify, making it difficult to maintain the shape of the mold. In this case, the sand is not solidified even after 50 minutes although a test temperature is kept for 20 to 50 minutes in Examples to be described below Meanwhile, when the temperature θ of the sand exceeds 30° C., a reaction between the binder and the hardening accelerator is promoted, and the sand is hardened too fast, making usable time thereof short, which may be less than one minute.

(Room Temperature Compressive Strength of Hardened Self-Hardening Sand)

<Specimen Room Temperature Compressive Strength Calculation Step>

It is assumed that the room temperature compressive strength $\sigma_c(\theta, t_i)$ [MPa] of the hardened self-hardening sand is determined by the dehydration condensation reaction of the resin. Further, the reaction rate of the resin at the time $t_1$ is different from that at the time $t_2$. Considering of the difference in reaction rate, the room temperature compressive strength $\sigma_c(\theta, t)$ of the hardened self-hardening sand can be expressed by the following equation (9).

[Math. 14]

$$\sigma_c(\theta,t)=\sigma_c(\Delta C(\theta,t_1))+\sigma_c(\Delta C(\theta,t_2)) \quad (9)$$

A first item on a right side of the above equation (9) is an increase in the room temperature compressive strength of the self-hardening sand due to progress of the reaction of the resin during the time $t_1$ [min] (that is, a period when the model exists in the hardened self-hardening sand or when the specimen to be described below is located in the mold). A second item on the right side of the above equation (9) is an increase in the room temperature compressive strength of the self-hardening sand due to the progress of the reaction of the resin during the time $t_2$ [min] (that is, a period when the hardened self-hard sand is left in the atmosphere from the time point when the model has been removed from the hardened self-hardening sand by model removal, or a period from a time point when the specimen is taken out of the mold to a time point just before the specimen is subjected to the compression test after being left in the atmosphere).

It is found, from a result of room temperature compression test of the specimen in a case where the reaction amount of the resin changes, that the first item on the right side of the equation (9) can be approximated by a hyperbolic function such as the following equation (10).

[Math. 15]

$$\sigma_c(\Delta C(\theta,t_1))=\tan h(\beta\cdot\Delta C(\theta,t_1))+\gamma \quad (10)$$

Here, β and γ are material parameters (constants). It is also found from the result of the same room temperature compression test that the second item on the right side of the above equation (9) can be approximated using a hyperbolic function such as the following equation (11).

[Math. 16]

$$\sigma_c(\Delta C(\theta,t_2))=\tan h(\varepsilon(\theta)\cdot\Delta C(\theta,t_2)-\eta) \quad (11)$$

Here, η is material parameter (constant). Further, ε is constant that changes with the temperature θ of the sand, and it is found to be expressed by the following equation (12).

[Math. 17]

$$\varepsilon(\theta)=a\theta+b \quad (12)$$

Here, a and b are constants.

Reaction amounts $\Delta C(\theta, t_1)$ [wt %] and $\Delta C(\theta, t_2)$ [wt %] of the resin obtained based on the above equations (1) and (2) are substituted into the following equation (3), so that the room temperature compressive strength $\sigma_c(\theta, t)$ [MPa] of the specimen (hardened self-hardening sand) can be obtained.

[Math. 18]

$$\sigma_c(\theta,t)=\{\tan h(\beta\cdot\Delta C(\theta,t_1))+\gamma\}+\{\tan h(\varepsilon(\theta)\cdot\Delta C(\theta,t_2)-\eta)\} \quad (3)$$

Here,

β, γ and η: material parameters, and

ε: constant determined by the temperature θ.

<Mold Room Temperature Compressive Strength Prediction Step>

Apart from the above specimen, the room temperature compressive strength $\sigma_{ca}$ (θ, t) of the mold is predicted in advance by applying the room temperature compressive strength $\sigma_c$(θ, t) of the specimen calculated in the specimen room temperature compressive strength calculation step to the room temperature compressive strength $\sigma_{ca}$(θ, t) of the mold when the mold is molded using the self-hardening sand under the molding condition parameters. This makes it possible to predict the room temperature compressive strength $\sigma_{ca}$(θ, t) of the mold obtained by molding under various molding condition parameters.

<Mold Room Temperature Compressive Strength Extraction Step>

The room temperature compressive strength $\sigma_{ce}$(θ, t) of the mold, under which the mold can be molded without damages and the model can be removed, is extracted from the above predicted room temperature compressive strength $\sigma_{ca}$(θ, t) of the mold by a test in advance. Accordingly, it can be found out in advance, among molds obtained by molding under various molding condition parameters, the range of the room temperature compressive strength of the mold required for achieving the object of the present invention.

Therefore, when the mold is actually molded, the model may be removed just after elapse of the time $t_1$, as one of the molding condition parameters which satisfies the room temperature compressive strength $\sigma_{ce}$(θ, t) extracted in the mold room temperature compressive strength extraction step.

Example 1

FIG. 1 illustrates a mold configured to mold a specimen, and (a) of FIG. 1 is a top view thereof and (b) of FIG. 1 is a front view thereof. A test was carried out to evaluate a reaction rate of a resin constituting self-hardening sand by molding a specimen using the mold as shown in FIG. 1, and measuring weight changes of the specimen. The reaction rate of resin is calculated based on the assumption that the weight changes of the specimen are all caused by dehydration condensation reaction of resin.

In FIG. 1, 1 is a molding mold made of cast iron, 2 is a split mold A constituting the molding mold 1, 3 is a split mold B facing the split mold A (2) constituting the molding mold 1, 2*a* and 3*a* are funnel-shaped half openings which are provided in respectively the split mold A (2) and the split mold B (3) and into which the self-hardening sand is poured, 2*b* and 3*b* are semi-cylindrical hollow portions which are provided in respectively the split mold A (2) and the split mold B (3) and are configured to mold cylindrical specimens. 2*c* is a through hole in the split mold A (2) configured to fasten the split mold A (2) and the split mold B (3) with a bolt (not illustrated), and 3*c* is a female thread portion in the split mold B (3) into which the bolt inserted into the through hole 2*c* is screwed.

In the self-hardening sand configured to mold the specimen, reclaimed silica sand No. 5 was used as the sand, furan resin (EF5302 manufactured by Kao Chemicals) was used as the binder, and xylene sulfonic acid-based hardening accelerators of different concentrations (TK-1 and C-21 manufactured by Kao Chemicals) were mixed and used as the hardening accelerator.

The furan resin was added in an amount of 0.8 wt % with respect to the reclaimed sand, and a mixture liquid of the hardening accelerators was added in an amount of 0.32 wt %.

The self-hardening sand (referred to as furan self-hardening sand) was prepared by using a general-purpose mixer in which the mixture liquid of the hardening accelerators was added to the reclaimed sand which was heated or cooled at a prescribed temperature, followed by kneading for 45 sec, and the furan resin was added, followed by kneading for 45 sec.

The prepared furan self-hardening sand after kneading was poured into a funnel-shaped opening configured by the funnel-shaped half openings 2*a* and 3*a* of the cast iron molding mold 1, followed by molding into a specimen of φ+30×60 mm in a cylindrical hollow portion configured by the semi-cylindrical hollow portions 2*b* and 3*b*.

In the present test, the reaction rate of resin was evaluated in consideration of the temperature θ [° C.] of the reclaimed sand before kneading, the time $t_1$ [min] from an end of kneading to a time point just before the model removal, and the time $t_2$ [min] from an end of the model removal to a time point just before a compression test of the specimen, which were molding condition parameters that affects a reaction rate of the furan resin (hereinafter, also simply referred to as resin).

The mold removal in the present test means taking the specimen out of the mold 1 after elapse of the time $t_1$.

In this test, the time $t_1$ and the time $t_2$ were changed for changing a contact area between the specimen and atmosphere.

Figure 2:
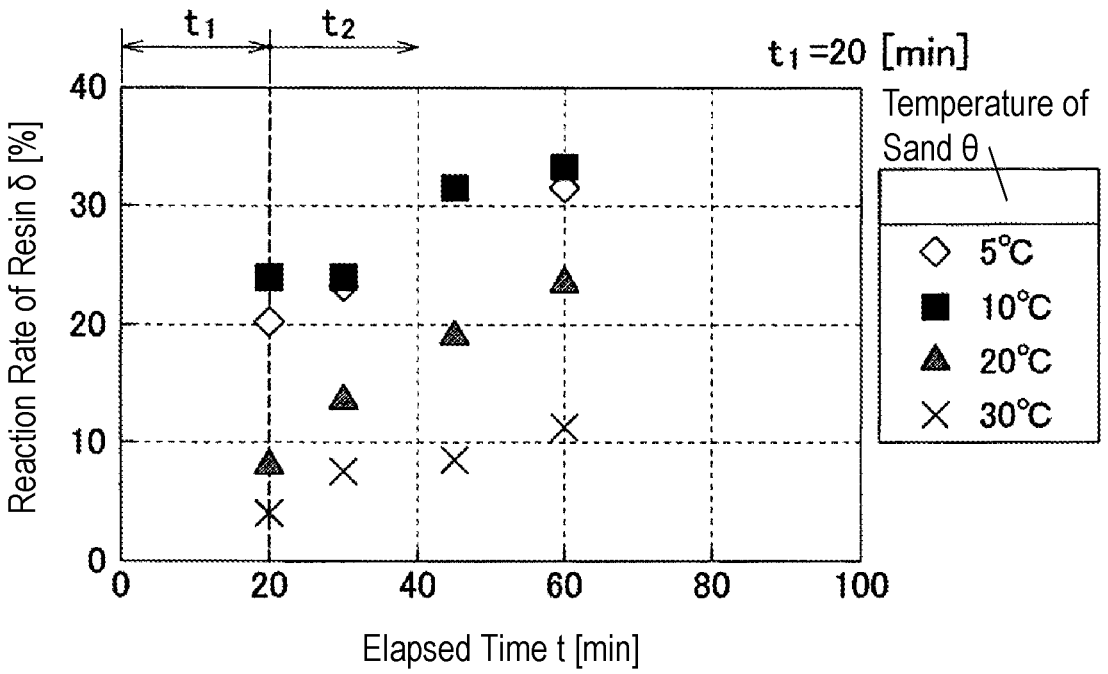
FIG. 2 shows a relationship between elapsed time t and a reaction rate δ of resin when a model is removed just after elapse of time $t_1$=20 min.
Figure 3:
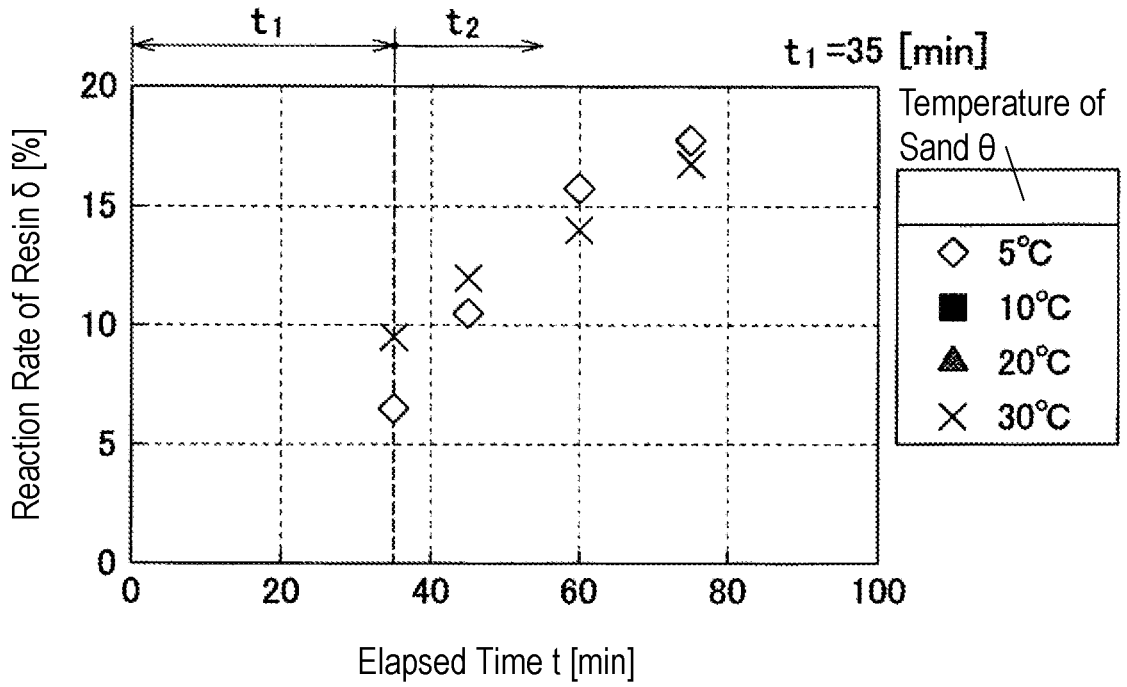
FIG. 3 shows a relationship between elapsed time t and a reaction rate δ of resin when a model is removed just after elapse of time $t_1$=35 min.
Figure 4:
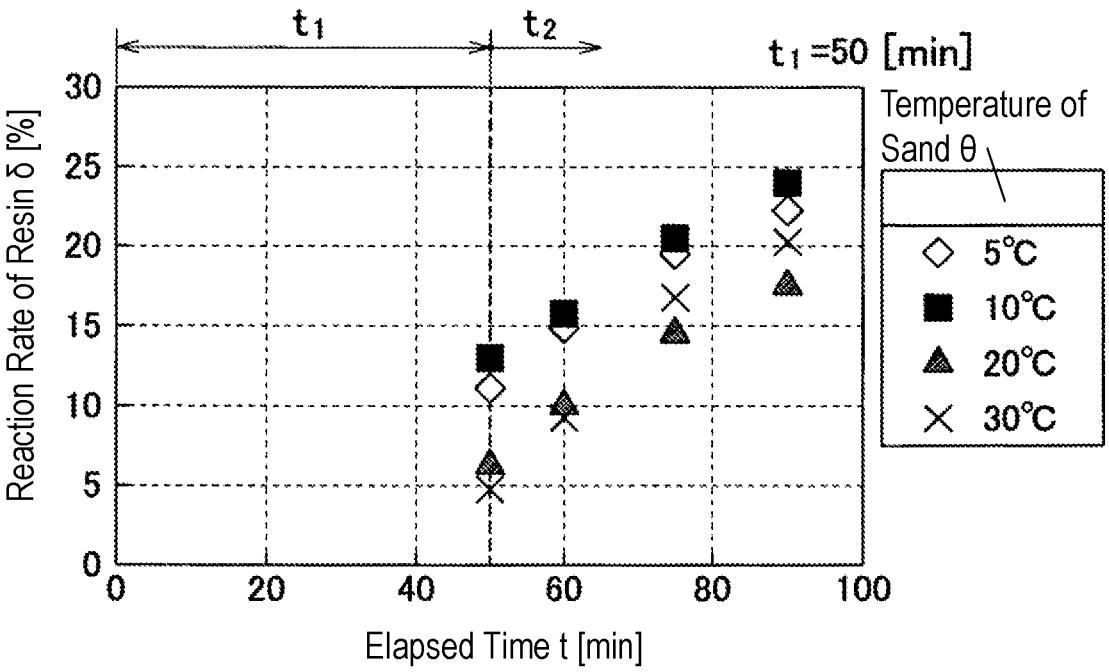
FIG. 4 shows a relationship between elapsed time t and a reaction rate δ of resin when a model is removed just after elapse of time $t_1$=50 min.

As the molding condition parameters in the present test, the temperature θ of the sand was changed to 5, 10, 20, and 30° C., the time $t_1$ was changed to 20, 35, 50 min, and the time $t_2$ was changed to 10, 25, and 40 min, so that the reaction rate δ of resin was evaluated based on the weight changes of the specimen defined by the following equation (13). The results are shown in FIG. 2 to FIG. 4.

[Math. 19]

$$\delta = \frac{w_0 - w_1}{w_0 - w_2} \times 100\% \tag{13}$$

Here, $w_0$ is weight [g] of the self-hardening sand poured into the mold 1 at first (=initial specimen weight), $w_1$ is specimen weight [g] after elapse of a certain time t [min] from the end of kneading, and $w_2$ is the specimen weight [g] after 24 hr from the end of kneading which is a time point when the reaction of the resin is considered totally completed. The elapsed time t includes the time $t_1$, the time $t_2$, and time after the time $t_2$.

In FIG. 2 to FIG. 4, a horizontal axis represents the elapsed time t [min] and a vertical axis represents the reaction rated δ [%] of resin.

FIG. 2 shows a relationship between the elapsed time t and the reaction rate δ of resin when a model is removed after elapse of the time $t_1$=20 min. In FIG. 2, the temperature θ of the sand was changed to 5, 10, 20, and 30° C. For each temperature θ, the time $t_1$ was fixed to 20 min, and only the time $t_2$ was changed to 10, 25, and 40 min.

In FIG. 2, the reaction rate δ of the resin is greatly different when the temperature θ of the sand differs even after elapse of the same time $t_1$=20 min. The reaction rate δ of the resin further increases with a lapse of the time $t_2$.

FIG. 3 shows a relationship between the elapsed time t and the reaction rate δ of resin when a model is removed after elapse of the time $t_1$=35 min. In FIG. 3, the temperature θ of the sand was changed to 5 and 30° C. For each temperature θ, the time $t_1$ was fixed to 35 min, and only the time $t_2$ was changed to 10, 25, and 40 min.

In FIG. 3, the reaction rate δ of the resin is different when the temperature θ of the sand differs even after elapse of the same time $t_1$=35 min. The reaction rate δ of the resin further increases with a lapse of the time $t_2$.

FIG. 4 shows a relationship between the elapsed time t and the reaction rate δ of resin when a model is removed after elapse of the time $t_1$=50 min. In FIG. 4, the temperature θ of the sand was changed to 5, 10, 20, and 30° C. For each temperature θ, the time $t_1$ was fixed to 50 min, and only the time $t_2$ was changed to 10, 25, and 40 min.

In FIG. 4, the reaction rate δ of the resin is different when the temperature θ of the sand differs even after elapse of the same time $t_1$=50 min. The reaction rate δ of the resin further increases with a lapse of the time $t_2$.

The results in FIG. 2 to FIG. 4 show that the reaction rate δ of the resin changes when the molding condition parameters change.

Figure 5:
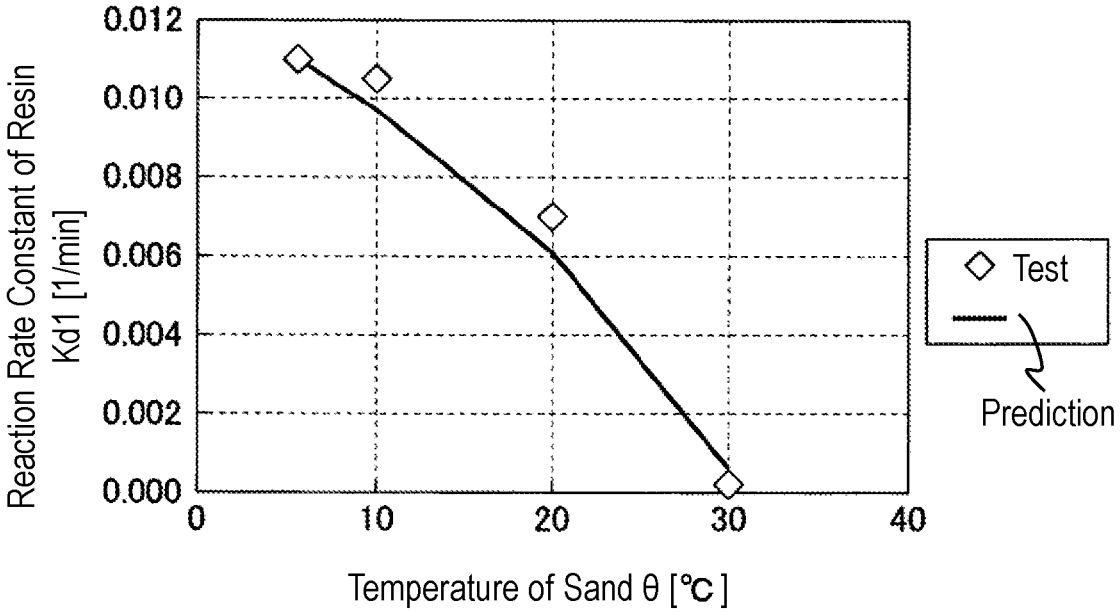
FIG. 5 shows a relationship between temperature θ of sand and reaction rate constant $k_{d1}$ of resin.
Figure 6:
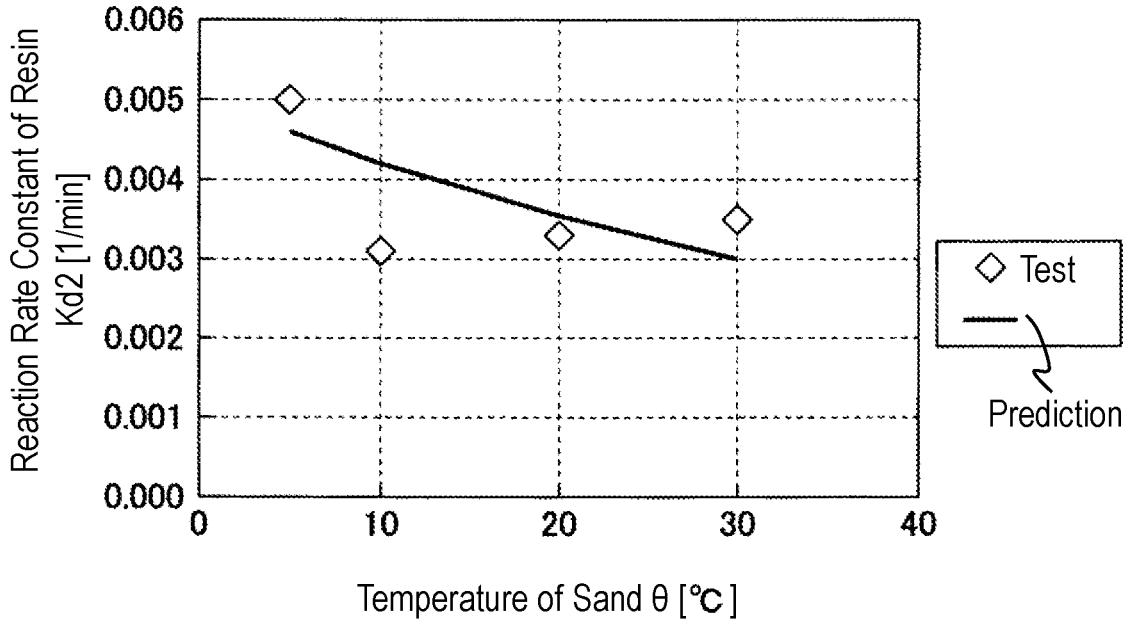
FIG. 6 shows a relationship between temperature θ of sand and reaction rate constant $k_{d2}$ of resin.

A relationship between the temperature θ of the sand and reaction rate constants $k_{d1}$, $k_{d2}$ of the resin identified based on the above results is shown in FIG. 5 and FIG. 6.

FIG. 5 and FIG. 6 show the relationship between the temperature θ of the sand and the reaction rate constants $k_{d1}$, $k_{d2}$ of the resin, respectively. The reaction rate constants $k_{d1}$, $k_{d2}$ of the resin refer to reaction rate constants of the resin at the time $t_1$ and the time $t_2$, respectively. In FIG. 5 and FIG. 6, ◇ marks are reaction rate constants $k_{d1}$, $k_{d2}$ of the resin obtained from the above test results, and solid lines are reaction rate constants $k_{d1}$, $k_{d2}$ of the resin predicted by the following equation (5).

[Math. 20]

$$\ln\frac{C_0}{C_{ti}} = k_{di}t_i,\ i = 1, 2 \tag{5}$$

In FIG. 5, the reaction rate constant $k_{d1}$ of the resin rapidly decreases from about 0.011 [l/min] to about 0.0005 [l/min] when the temperature θ of the sand changed from 5 to 30° C. This is considered to be caused by continuous progress of the reaction of the resin even during kneading of the sand, the resin, and the hardening agent, each constituting the self-hardening sand. That is, it is considered that the higher the temperature θ of the sand is, the greater the reaction progress of the resin during kneading is, and the reaction rate constant km of the resin decreased as the temperature θ of the sand increased during the time $t_1$ from the end of kneading to a time point just before the model removal.

In FIG. 6, the reaction rate constant $k_{d2}$ of the resin decreases from about 0.005 [l/min] to about 0.0035 [l/min] when the temperature θ of the sand changed from 5 to 30° C. However, a decreasing tendency of the reaction rate constant $k_{d2}$ of the resin with respect to an increase in the temperature θ of the sand is smaller than that of the reaction rate constant $k_{d1}$ of the resin with respect to the increase in the temperature θ of the sand.

As a result of identifying $A_i$ and $\alpha_i$ from the above test results, it was found that $A_1$=−0.004, $\alpha_1$=0.045, $A_2$=0.005, and $\alpha_2$=−0.017.

From the above results, it was found that the reaction amount ΔC(θ, $t_1$) [wt %] (i=1, 2) of the resin as the binder can be predicted by using the above equations (1) and (2).

Example 2

Next, a compression test was carried out using a specimen of φ30×60 mm molded under the same molding condition parameters as those prepared for the above test of evaluating the reaction rate of resin. That is, when the temperature θ of the sand was 5, 10, 20, and 30° C., a plurality of specimens having three levels of the reaction amount ΔC(θ, $t_i$) of resin were molded for each of the temperatures θ by changing the time $t_1$ and the time $t_2$, respectively. The compression test was carried out with these specimens so that the average room temperature compressive strength $\sigma_c$(θ, t) [MPa] was obtained. The test results are shown in FIG. 7 to FIG. 10, respectively.

Figure 7:
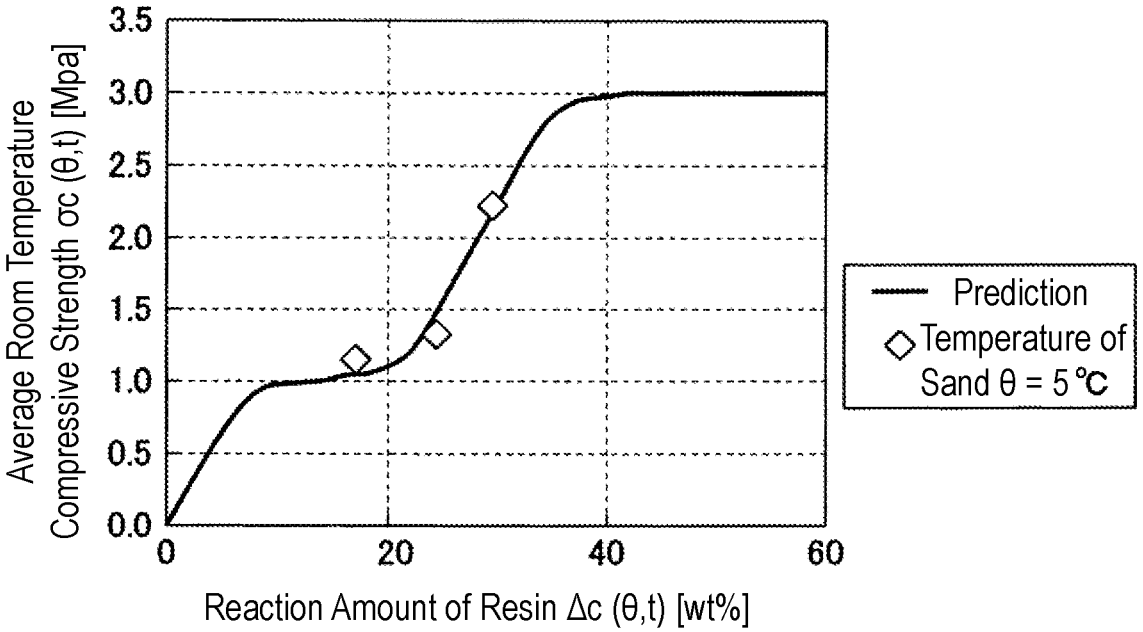
FIG. 7 shows a relationship between a reaction amount $\Delta C(\theta, t)$ of resin and an average room temperature compressive strength $\sigma_c(\theta, t)$ (sand temperature θ=5° C.).

FIG. 7 shows a relationship between the reaction amount ΔC(θ, t) of resin and the average room temperature compressive strength $\sigma_c$(θ, t) (sand temperature θ=5° C.), in which ◇ marks are the test results, and a solid line is the average room temperature compressive strength $\sigma_c$(θ, t) predicted by the following equation (3).

[Math. 21]

$$\sigma_c(\theta,t)=\{\tan h(\beta\cdot\Delta C(\theta,t_1))+\gamma\}+\{\tan h(\varepsilon(\theta)\cdot\Delta C(\theta,t_2)-\eta)\} \tag{3}$$

Here,

β, γ and η: material parameters, and

ε: constant determined by the temperature θ.

Figure 8:
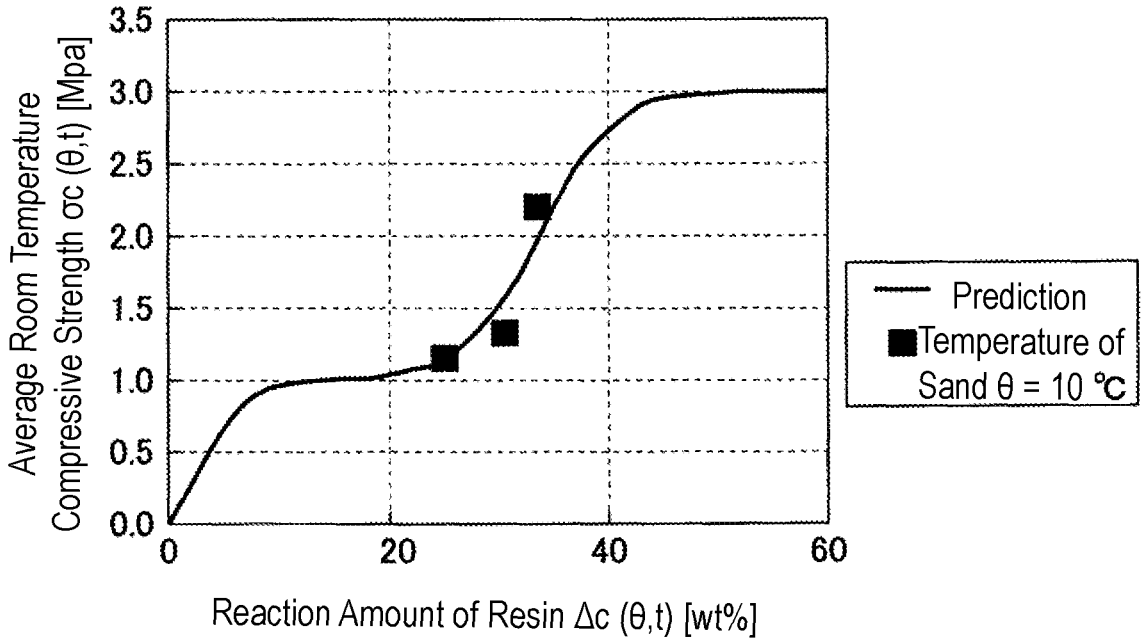
FIG. 8 shows a relationship between a reaction amount $\Delta C(\theta, t)$ of resin and an average room temperature compressive strength $\sigma_c(\theta, t)$ (sand temperature θ=10° C.).

FIG. 8 shows a relationship between the reaction amount ΔC(θ, t) of resin and the average room temperature compressive strength $\sigma_c$ (θ, t) (sand temperature θ=10° C.), in which □ marks are the test results, and a solid line is the average room temperature compressive strength $\sigma_c$(θ, t) predicted by the above equation (3).

Figure 9:
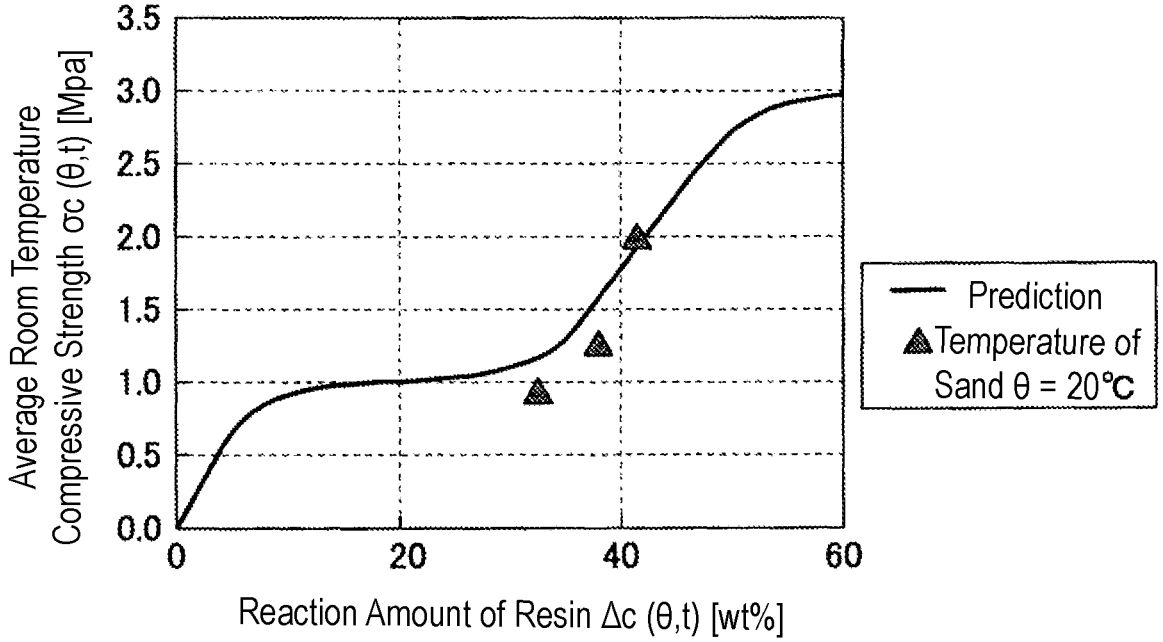
FIG. 9 shows a relationship between a reaction amount $\Delta C(\theta, t)$ of resin and an average room temperature compressive strength $\sigma_c(\theta, t)$ (sand temperature θ=20° C.).

FIG. 9 shows a relationship between the reaction amount ΔC(θ, t) of resin and the average room temperature compressive strength $\sigma_c$(θ, t) (sand temperature θ=20° C.), in which ▲ marks are the test results, and a solid line is the average room temperature compressive strength $\sigma_c$(θ, t) predicted by the above equation (3).

Figure 10:
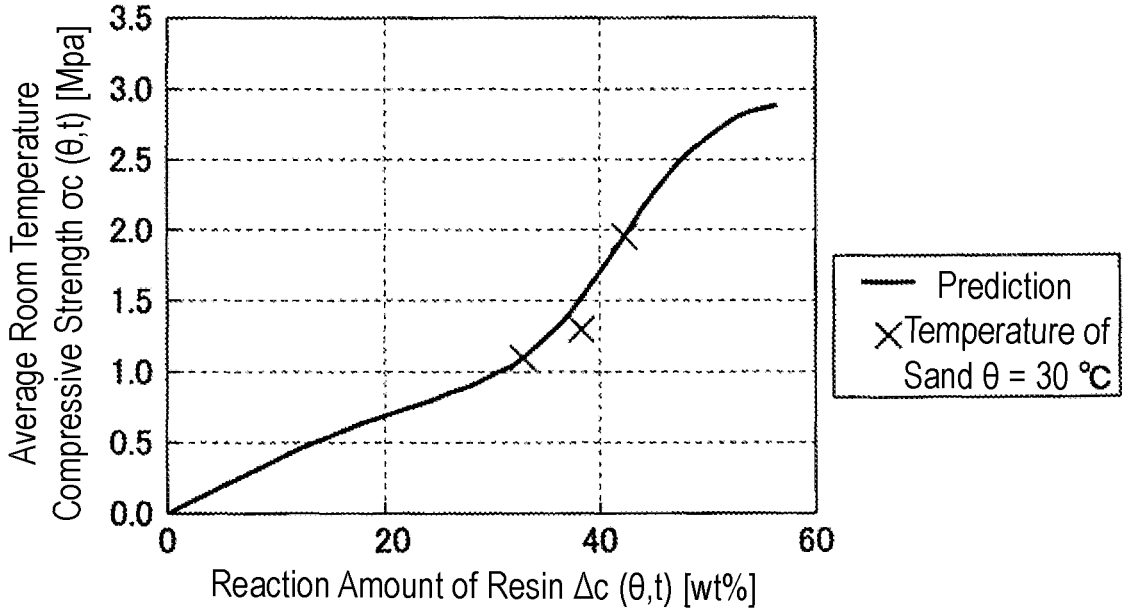
FIG. 10 shows a relationship between a reaction amount $\Delta C(\theta, t)$ of resin and an average room temperature compressive strength $\sigma_c(\theta, t)$ (sand temperature θ=30° C.).

FIG. 10 shows a relationship between the reaction amount ΔC(θ, t) of resin and the average room temperature compressive strength $\sigma_c$(θ, t) (sand temperature θ=30° C.), in which x marks are the test results, and a solid line is the average room temperature compressive strength $\sigma_c$(θ, t) predicted by the above equation (3).

As a result of identifying β, γ, and η, which are material parameters (constants), from the above test results, it was found that β=0.25, γ=1.0, and η=4.8.

Further, ε represented by the following equation (12) was constant that changes with the temperature θ of the sand, and constants a and b on a right side were: a=−0.0161, and b=0.6222.

[Math. 22]

$$\varepsilon(\theta)=a\theta+b \tag{12}$$

From the above results, it was found that the room temperature compressive strength $\sigma_c$(θ, t) of the specimen can be calculated by using the above equation (3), and that the room temperature compressive strength $\sigma_{ca}$(θ, t) of a mold molded under the same molding condition parameters can be predicted in advance by applying the calculated room temperature compressive strength σ(θ, t) of the specimen to the room temperature compressive strength $\sigma_{ca}$(θ, t) of the mold.

Example 3

Figure 11:
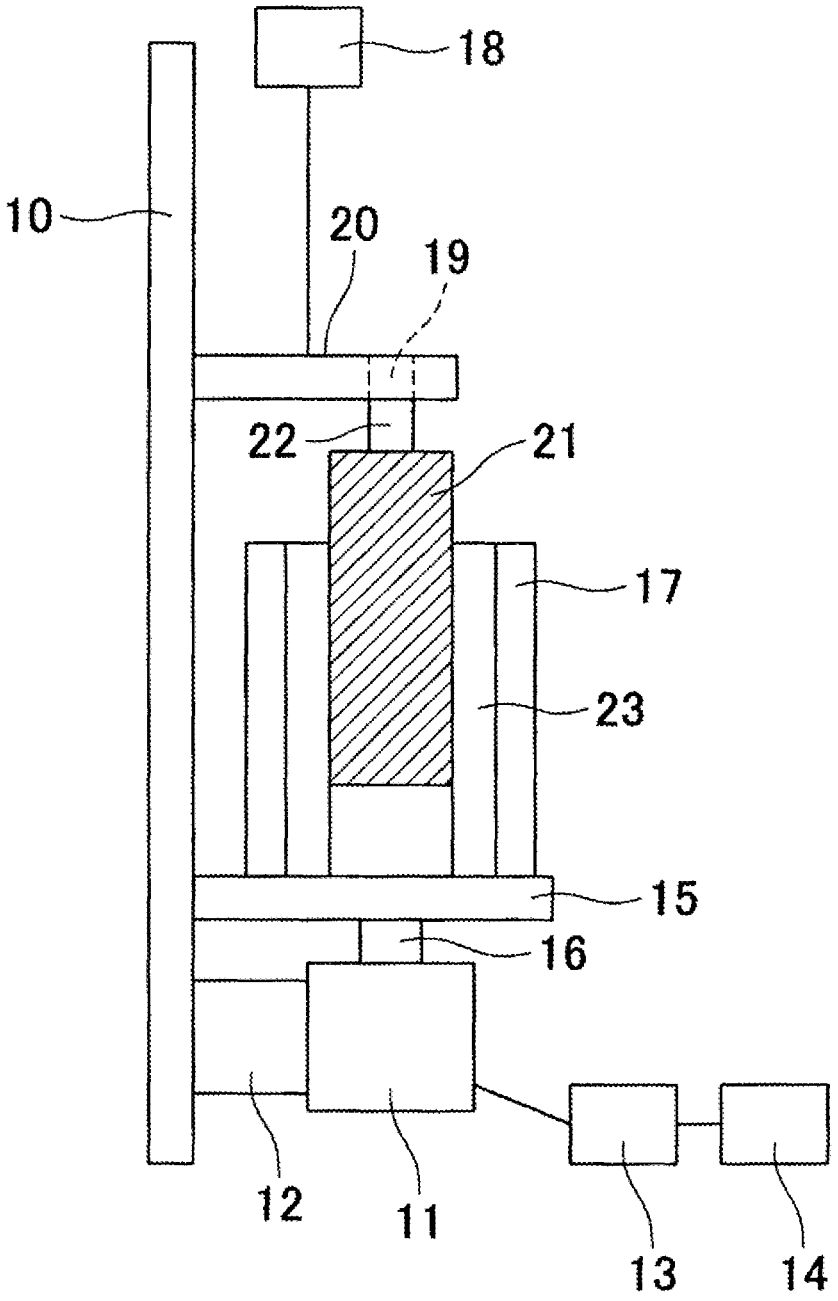
FIG. 11 is a schematic front sectional view of a configuration of a mold molding device.

FIG. 11 illustrates a mold molding device for extracting the room temperature compressive strength $\sigma_{ce}$(θ, t), under which a mold can be molded without damages and a model can be removed, in advance by a test (mold room temperature compressive strength extraction step) from the room temperature compressive strength $\sigma_{ca}(\theta, t)$ of the mold predicted in advance by the above method.

FIG. 11 is a schematic front sectional view illustrating a configuration of the mold molding device. In FIG. 11, 10 is a column, 11 is a motor, 12 is a fixing tool that fixes the motor 11 to the column 10, 13 is an inverter that drives the motor 11, 14 is a power source connected to the inverter, 15 is a rotary table. 16 is a coupling tool configured to attach the motor 11 to rotary table 15, 17 is a cylindrical wooden frame attached to the rotary table 15, 18 is a balancing device, 20 is a shaft holder coupled to the balancing device 18 and attached to a scroll chuck 19, 21 is a model having a twisted shape attached to a shaft 22 attached to the scroll chuck 19, 23 is the self-hardening sand same as in Example 1 with which the wooden frame 17 in which the model 21 is located is filled.

Figure 12:
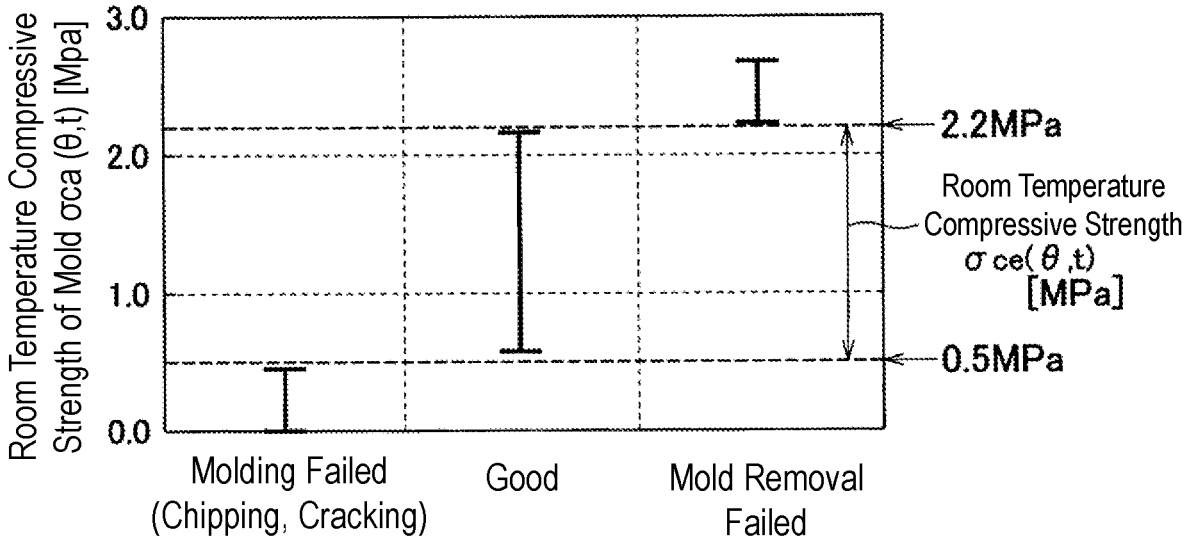
FIG. 12 shows a relationship between room temperature compressive strength $\sigma_{ca}(\theta, t)$ of a mold and a performance of the mold.

The mold is molded under the same molding condition parameters described above (that is, the temperature θ of the sand which constitutes the furan self-hardening sand 23, and the time $t_1$ are changed), in which the model 21 is removed while being rotated around the shaft 22 while keeping a balance by the balancing device 18 after elapse of the time A relationship between the room temperature compressive strength $\sigma_{ca}(\theta, t)$ of the mold molded in this manner (that is, the room temperature compressive strength $\sigma_{ca}(\theta, t)$ of the mold predicted in advance) is shown in FIG. 12.

In FIG. 12, when the room temperature compressive strength $\sigma_{ca}(\theta, t)$ of the molded mold is less than 0.5 [MPa] the mold cannot be molded since chipping or cracking occurs in a part or a large portion of the mold. When the room temperature compressive strength $\sigma_{ca}(\theta, t)$ of the molded mold is greater than 2.2 [MPa], the model cannot be removed from the mold. In contrast, when the room temperature compressive strength $\sigma_{ca}(\theta, t)$ of the molded mold is within a range of 0.5 [MPa] to 2.2 [MPa.] (that is, the room temperature compressive strength $\sigma_{ce}(\theta, t)$ on a vertical axis on a right side in FIG. 12 satisfies 0.5 [MPa]≤$\sigma_{ce}(\theta, t)$ [MPa]≥2.2 [MPa]), a good mold (which can be molded without damages and the model can be removed) can be molded.

As described above, it was found that the room temperature compressive strength $\sigma_{ce}(\theta, t)$ of the mold, under which the mold can be molded without damages and the model can be removed, can be extracted from the predicted room temperature compressive strength $\sigma_{ca}(\theta, t)$ in advance by a test.

Therefore, when the mold is actually molded, a model may be removed after elapse of the time $t_1$, as a molding condition parameter which satisfies the room temperature compressive strength $\sigma_{ce}(\theta, t)$ of the mold extracted in the mold room temperature compressive strength extraction step. Accordingly, even when molding conditions change when the mold is actually molded, the mold can be molded without damages and the model can be removed, without carrying out a test each time the molding conditions change.

The embodiments of the present invention are described above. However, specific examples are given for illustrative purposes only, and are not intended to limit the present invention. Specific configurations and the like may be modified as appropriate. Further, the operations and effects described in the embodiment of the present invention are merely examples of the most preferable operations and effects achieved by the present invention, and the present invention is not limited thereto.

The present application is based on Japanese Patent Application No. 2016-174863 filed on Sep. 7, 2016, contents of which are incorporated herein by reference.

INDUSTRIAL APPLICABILITY

According to the present invention, a mold can be molded without damages and without carrying out experiments each time when a molding condition is changed when the mold is actually molded.

DESCRIPTION OF REFERENCE NUMERALS

1 Molding mold
2 Split mold A
3 Split mold B
2*a*, 3*a* Funnel-shaped half opening
2*b*, 3*b* Semi-cylindrical hollow portion
2*c* Through hole
3*c* Female thread portion
10 Column
11 Motor
12 Fixing tool
13 Inverter
14 Power source
15 Rotary table
16 Coupling tool
17 Cylindrical wooden frame
18 Balancing device
19 Scroll chuck
20 Shaft holder
21 Model
22 Shaft
23 Furan self-hardening sand

The invention claimed is:

1. A mold molding method that molds a mold by filling a frame, in which a model is placed, with self-hardening sand obtained by kneading sand, a binder, and a hardening accelerator, and removing the model after the self-hardening sand is hardened, so that a shape of the model is transferred to the hardened self-hardening sand, the mold molding method comprising:

a binder reaction amount calculation step of calculating a reaction amount $\Delta C(\theta, t_i)$ [wt %] (i=1, 2) of the binder based on the following equations (1) and (2) using, as molding condition parameters when a specimen is molded using the self-hardening sand, temperature θ [° C.] of the sand before kneading, time $t_1$ [min] from an end of the kneading to a time point when the model has been removed from the hardened self-hardening sand, and time $t_2$ [min] from the time point just after the model has been removed from the hardened self-hardening sand to a time point just before the specimen is subjected to a compression test;

a specimen room temperature compressive strength calculation step of calculating room temperature compressive strength $\sigma_c(\theta, t)$ [MPa] of the specimen by substituting the reaction amounts $\Delta C(\theta, t_1)$ and $\Delta C(\theta, t_2)$ calculated in the binder reaction amount calculation step into the following equation (3);

a mold room temperature compressive strength prediction step of predicting room temperature compressive strength $\sigma_{ca}(\theta, t)$ of the mold in advance by applying the room temperature compressive strength $\sigma_c(\theta, t)$ of the specimen calculated in the specimen room temperature compressive strength calculation step to room temperature compressive strength $\sigma_{ca}(\theta, t)$ of the mold when the mold is molded using the self-hardening sand under the molding condition parameters; and a mold room temperature compressive strength extraction step of extracting room temperature compressive strength $\sigma_{ce}(\theta, t)$ of the mold, under which the mold can be molded without damages and the model can be removed, from the predicted room temperature compressive strength $\sigma_{ca}(\theta, t)$ of the mold by a test in advance, wherein when the mold is actually molded, the model is removed just after elapse of the time $t_1$, as one of the molding condition parameters which satisfies the room temperature compressive strength $\sigma_{ce}(\theta, t)$ extracted in the mold room temperature compressive strength extraction step:

$$\Delta C(\theta,t_i)=\Delta C_{sat}\cdot\{1-\exp(-k_{di}t_i)\} \quad (1)$$

wherein $\Delta C_{sat}$: a saturated reaction amount [wt %] of the binder, and $k_{di}$(i=1, 2): reaction rate constant [l/min] of the binder;

$$k_{di}=A_i \exp(\alpha_i\theta) \quad (2)$$

wherein $A_i$(i=1, 2) and $\alpha_i$ (i=1, 2): parameters dependent on kind of the binder used; and $$\sigma_c(\theta,t)=\{\tan h(\beta\cdot\Delta C(\theta,t_1))+\gamma\}+\{\tan h(\varepsilon(\theta)\cdot\Delta C(\theta,t_2)-\eta)\} \quad (3)$$

wherein $\beta$, $\gamma$ and $\eta$: material parameters, and $\varepsilon$: constant determined by the temperature $\theta$.

2. The mold molding method according to claim 1, wherein the room temperature compressive strength $\sigma_{ce}(\theta, t)$ satisfies: 0.5 [MPa]≤$\sigma_{ce}(\theta, t)$ [MPa]≤2.2 [MPa].

3. The mold molding method according to claim 2, wherein the temperature $\theta$ of the sand is 5 to 30° C.

4. The mold molding method according to claim 1, wherein the temperature $\theta$ of the sand is 5 to 30° C.

* * * * *